US005976266A

United States Patent [19]

Anderson et al.

[11] Patent Number: 5,976,266

[45] Date of Patent: Nov. 2, 1999

[54] METHOD FOR CLEANING AND WRINGING MOP

[75] Inventors: Ronald K. Anderson, Denton; Geno J. Guglielmi, Grand Prairie; Raymond K. Wilcox, Granbury, all of Tex.

[73] Assignee: GSP Products, Inc., Dallas, Tex.

[21] Appl. No.: 08/874,645

[22] Filed: Jun. 13, 1997

Related U.S. Application Data

[60] Provisional application No. 60/028,013, Oct. 9, 1996.

[51] Int. Cl.[6] ..... B08B 7/00; A47L 13/14; A47L 13/20; A47L 13/58

[52] U.S. Cl. ..... 134/6; 134/32; 134/42; 15/119.1

[58] Field of Search ..... 134/42, 6, 32; 15/116.1, 119.1, 120.1, 120.2, 260

[56] References Cited

U.S. PATENT DOCUMENTS 3,462,788 8/1969 Abbott ..... 15/119
5,060,338 10/1991 Yates et al. ..... 15/119 A
5,675,858 10/1997 von Meyer ..... 15/119.1

*Primary Examiner*—Zeinab El-Arini
*Attorney, Agent, or Firm*—Geoffrey A. Mantooth

[57] ABSTRACT

A mop is provided with a handle, mop strings and a plunger. The plunger is located between the handle and the mop strings. A sleeve having a top end and an open bottom end is provided, with the sleeve being perforated near the bottom end. The sleeve is tapered so that the bottom end is larger than the top end. The plunger and the mop strings are located inside of the sleeve with the plunger positioned near the top end of the sleeve and the mop strings depending from the plunger. The bottom end of the sleeve is located in a liquid so that the liquid enters a bottom portion of the sleeve through the perforations. The handle is moved down so as to compress the mop strings with the plunger, with the mop strings being immersed in the liquid, forcing dirt from the mop strings out of the sleeve perforations. The handle is moved up so as to raise the plunger inside of the sleeve and decompress the mop strings, thereby allowing the mop strings to absorb liquid from outside of the sleeve through the perforations. The steps of moving the handle up and down are repeated until the mop strings are clean.

7 Claims, 13 Drawing Sheets

METHOD FOR CLEANING AND WRINGING MOP

This application claims the benefit of U.S. Provisional Application No. 60/028,013, filed Oct. 9, 1996.

FIELD OF THE INVENTION

The present invention relates to mops that utilize strings, and in particular to apparatuses for wringing water from such mop strings.

BACKGROUND OF THE INVENTION

Wet mops are commonly used to clean large surfaces such as floors. To use a mop, the mop head is immersed in a cleaning solution (such as water and detergent). The mop head is then raised from the solution and wrung out to remove the excess solution. The mop is then used to clean the floor. After some use, the mop head becomes relatively dry and dirty. Therefore, the mop head is reimmersed into the cleaning solution to clean the mop head and rewet it.

Wringing the mop head not only serves to reduce the wetness of the mop, but also to clean the mop head. As the mop is wrung, water carries dirt away from the mop head.

A good wet mop wringing system should require a minimum of effort to wring the mop, no need to make hand contact with the wet mop head itself or liquid running out of the mop head, and an easy way to rinse the mop.

Mop wringing systems are generally classified as being bucket mounted or mop mounted.

Prior art bucket mounted wringing systems are attached to wash buckets and use hand or foot pressure to wring the mops. Bucket mounted systems tend to be expensive and difficult to use. Placement of the mop into the wringing mechanism may be difficult. Also, bucket mounted systems require a combination of forces to wring the mop, the application of which forces may be ergonomically difficult. One type of bucket mounted wringing system is a compression plate system. This system requires the operator to hold the mop handle in one hand, while bending over and using the other hand to pull a wringing lever. Another type of bucket mounted wringing system is a pinch roller system. With this system, the operator holds the handle with one hand, while using the other hand or a foot to pinch the mop between two rollers. The mop handle is pulled upwardly to pull the mop head through the rollers. Still another type of bucket mounted wringing system requires the operator to simultaneously twist the mop in the bucket and push down on the mop. The operator must attempt to maintain the pressure centered over the mop head to most effectively wring it.

The mop mounted wringing systems can be classified according to whether the mop is a string mop or a sponge mop.

There are two commonly produced prior art string mop mounted wringing systems. Both systems are commonly known as twist mops and utilize mechanisms mounted on the handles. Both systems require the operator to simultaneously apply two separate forces to the mop. To wring, the mechanism is pushed down over the mop head and twisted. The operator must hold the mop stationary with one hand while twisting the mechanism. One of the mop mounted wringing system utilizes a large portion of the mop head strands for attaching the strands to the mechanism. For example, 1–2 inches of strand out of 14 inches is utilized for attachment. Consequently, a relatively large portion of the strand is useless for mopping. Also, the wringing action occurs over a long portion of the mop handle, wherein some of the excess water that is wrung out misses the bucket and falls onto the floor that is being mopped. If the operator holds the mop vertically while twisting, the wringing becomes difficult because of the awkward angle. The other mop mounted wringing system has grooves inside of the mechanism. This system, is shown in Yates et al., U.S. Pat. No. 5,060,338. The grooves make twisting with the proper torque difficult. The length of the mop head is limited because with a long mop head, the upper end of the mop head cannot be satisfactorily wrung.

Prior art sponge mop mounted wringing systems suffer from several disadvantages. Because sponges lack the flexibility of string mops, the size of the sponge is limited. The larger the sponge, the larger the mechanical support that is required, thereby increasing the cost of the mop. The wringing mechanism requires at least one hinge, which increases the mop cost and the chance of mechanical failure. The sponge is coupled to a plastic or metal support. The support is made smaller than the sponge in order to avoid contact between the support and the floor or furniture (contact would cause scratching). Therefore, the edges of the sponge are not effectively wrung out (because the edges are not bound to the support). Sponge mops cover less surface area than do standard string mops. Furthermore, sponge mops become extremely rigid and brittle upon drying and require the user to wet the sponge before use.

SUMMARY OF THE INVENTION

It is an object of the present invention to provide a mop wringing system that requires a minimum of effort to wring the mop.

If is a further object of the present invention to provide a mop wringing system that allows the mop to be wrung without contacting the operator's hands with the mop head and any liquid being wrung out of the mop head.

It is a further object of the present invention to provide a mop wringing system that simplifies rinsing the mop.

The present invention provides an apparatus for wringing mops. The apparatus includes a handle, a plunger, a plurality of mop strings, and a sleeve. The handle has first and second ends. The plunger is located at the second end of the handle. The mop strings are secured to the second end of the handle by way of the plunger. The mop strings are made of a material that is different than a plunger. The sleeve has third and fourth ends. The third end is slidably received by the handle and is closed. The fourth end is open and is structured and arranged to bear against a surface. The sleeve has a cavity therein that extends from the open fourth end toward the third end. The sleeve is slidable along the handle between a first position and a second position, wherein when the sleeve is in the first position, the mop strings are located outside of the cavity and when the sleeve is in the second position, the mop strings are located inside of the cavity. The sleeve is perforated near the fourth end. The inside of the sleeve has a diameter that increases from the third end to the fourth end.

With the apparatus of the present invention, an operator uses minimum effort to wring the mop strings out. The operator simply pushes down on the mop handle with one or both hands to plunge the mop strings inside of the sleeve, thereby forcing liquid out of the mop strings. With the present invention, the operator's hands need not contact any liquid or wet surfaces. By providing a sleeve that is tapered from the third end to the fourth end, the mop strings do not become impacted within the sleeve during wringing, wherein the sleeve can be slid so as to uncover the wrung head.

In accordance with one aspect of the present invention, the strings comprise natural fibers. In accordance with another aspect of the present invention, the strings comprise a flexible and resilient foam.

In accordance with still another aspect of the present invention, the sleeve has a smooth inside wall.

In accordance with another aspect of the present invention, the plunger is removably coupled to the handle. Thus, the plunger serves a dual purpose both to couple the mop strings to the handle and also to plunge the mop strings during wringing operations. By removing the plunger from the handle, the plunger and mop strings can be easily replaced. This allows the owner to retain the handle and the sleeve and replace the mop strings, which frequently wear out.

In accordance with another aspect of the present invention, the sleeve is maintained in the first position along the handle by a releasable retainer.

In accordance with another aspect of the present invention, the plunger comprises a wall that extends radially outward from a longitudinal axis of the handle.

In accordance with still another aspect of the present invention, the apparatus further comprises a plunge object. The plunge object has a bulge, with an annular lip around the bulge. The lip comprises the surface that the sleeve fourth end bears against, wherein when the fourth end of the sleeve bears against the lip, the bulge protrudes into the sleeve. Plunging the handle down forces the mop strings onto the bulge. The bulge assists in wringing the mop strings and prevents the compressed mop strings from being impacted inside of the sleeve.

In accordance with another aspect of the present invention, the fourth end of the sleeve has a diameter that is substantially similar to the diameter of the lip of the plunge object. Thus, when the fourth end of the sleeve is inserted onto the plunge object, the sleeve is automatically centered over the bulge. The bulge can be frusto-conical in shape.

In accordance with another aspect of the present invention, the bulge is perforated.

In accordance with another aspect of the present invention, the plunge object further comprises a spacer wall that extends in the opposite direction from the bulge. The spacer wall is adapted to bear on a bottom of a bucket.

In accordance with another object of the present invention, the plunge object further comprises a hanger wall that extends in the same direction as the bulge. The hanger wall is adapted to bear on a top edge of a bucket.

In accordance with still another aspect of the present invention, a scrubber is coupled to the plunger.

The present invention also provides a method of cleaning a mop. The mop is provided with a handle, mop strings, and a plunger. The plunger is located between the handle and the mop strings. A sleeve is also provided, which sleeve has a top end and an open bottom end. The sleeve is perforated near the bottom end and is tapered so that the bottom end is larger than the top end. The plunger and the mop strings are located inside of the sleeve, with the plunger being positioned near the top end of the sleeve and the mop strings depending from the plunger. The bottom end of the sleeve is located in liquid so that the liquid enters a bottom portion of the sleeve through the perforations. The handle is moved down so as to compress the mop strings with the plunger, with the mop strings being immersed in the liquid, thereby forcing dirt from the mop strings out of the sleeve through the perforations. The handle is then moved up so as to raise the plunger inside of the sleeve and decompress the mop strings, thereby allowing the mop strings to absorb liquid from outside of the sleeve through the perforations. The handle is repeatedly moved up and down until the mop strings are cleaned.

With the method of the present invention, it is easy for an operator to rinse a mop clean. The bottom end of the sleeve is simply immersed in liquid and the handle is plunged up and down. This plunging action forces dirty water out of the mop strings, during the down stroke, and absorbs clean water from outside of the sleeve on the up stroke.

BRIEF DESCRIPTION OF THE DRAWINGS

FIG. 2 is a side view of the mop head.

FIG. 3 is an exploded end view of the mop head.

FIG. 4 is an exploded side view of the mop head, with a cross-section of the coupler, taken through lines IV—IV of FIG. 3.

DESCRIPTION OF THE PREFERRED EMBODIMENT

Figure 1:
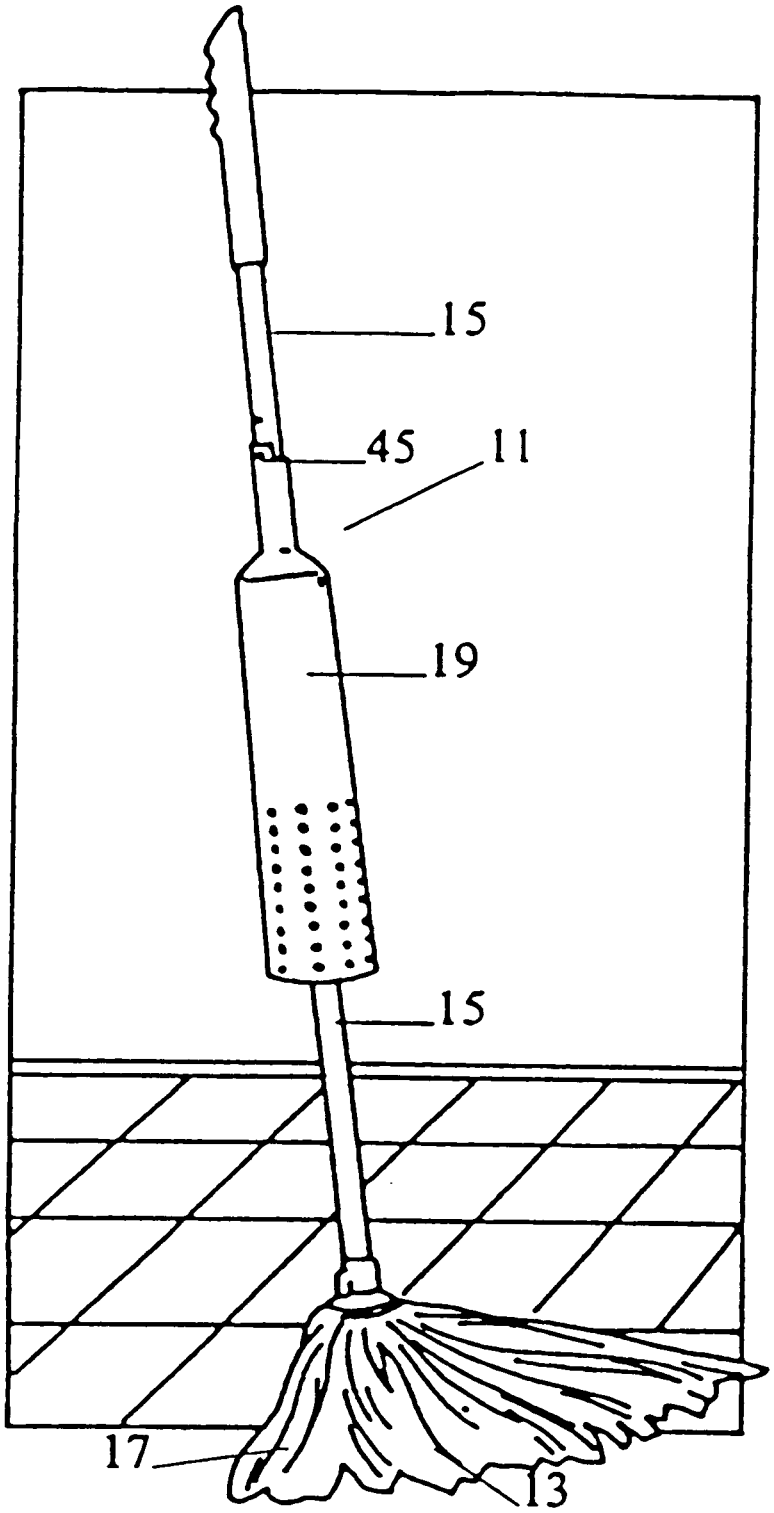
FIG. 1 is a side view of a mop and wringing apparatus of the present invention, as used on a floor and in accordance with a preferred embodiment.

In FIG. 1, there is shown the mop 11 of the present invention, in accordance with a preferred embodiment. The mop 11 includes a handle 15, a mop head 17, and a sleeve 19.

The sleeve 19 is used to wring excess liquid out of the mop head. Wringing can be performed while keeping the operator's hands dry. In addition, wringing is accomplished by merely seating the bottom end of the sleeve against a surface, and then pushing down on the mop handle. No twisting motion is needed.

The various parts of the mop 11 is will now be described. The handle 15 is typically a stick made of wood, although other materials can be used. The handle has a top end and a bottom end. The bottom end is threaded to allow coupling to the mop head.

The mop head 17 has a fitting 21 and multiple loops of string 13.

Figure 2:
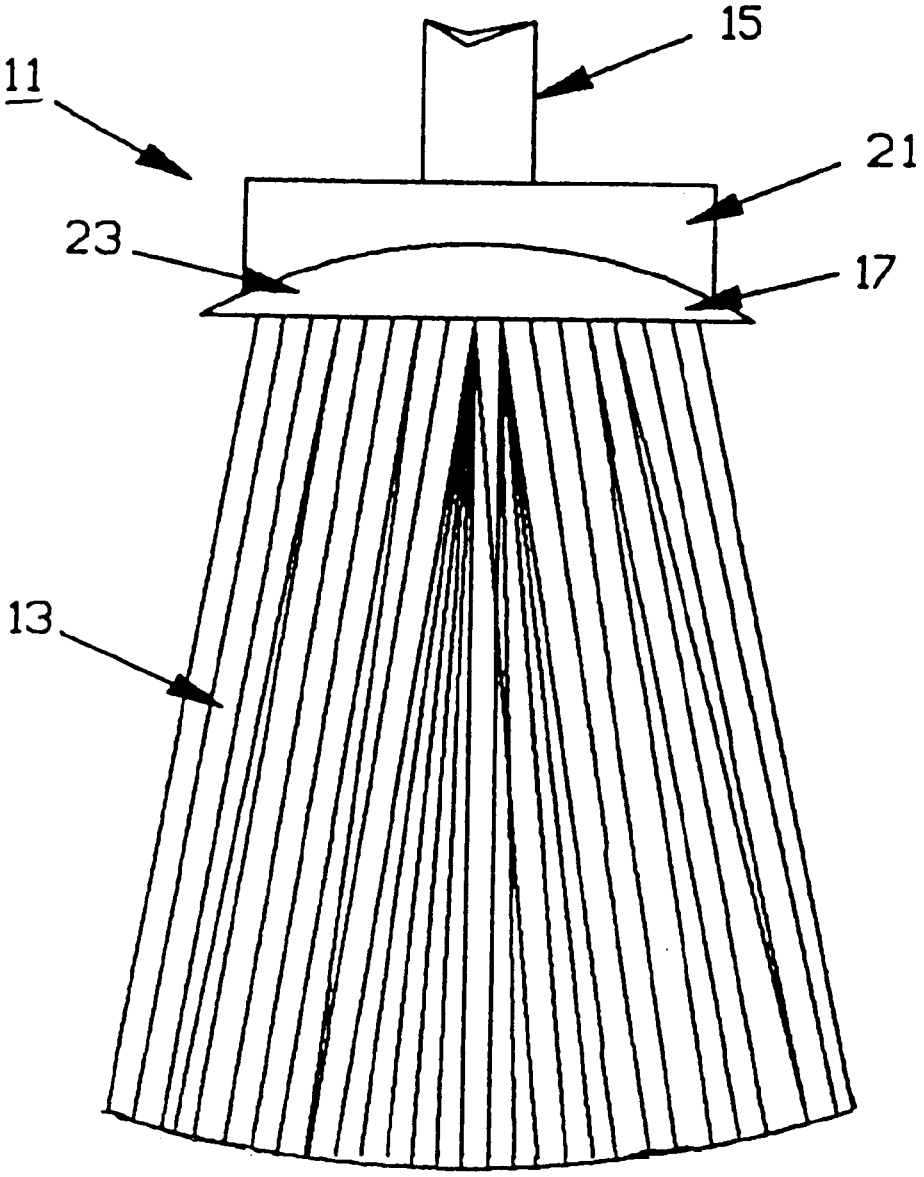
FIGS. 2–4 are views of the mop head, shown without the sleeve.
Figure 4:
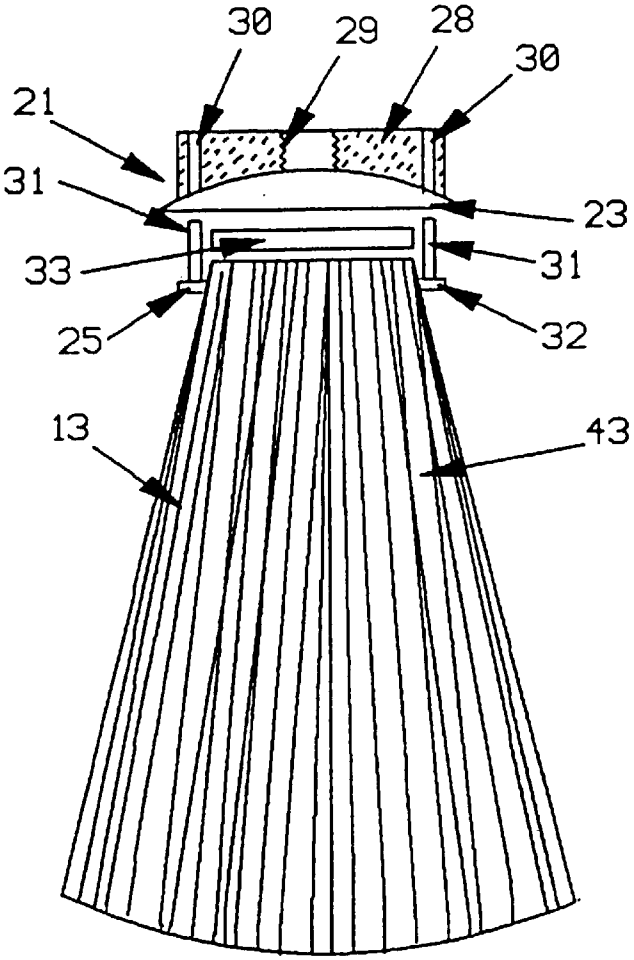
Figure 3:
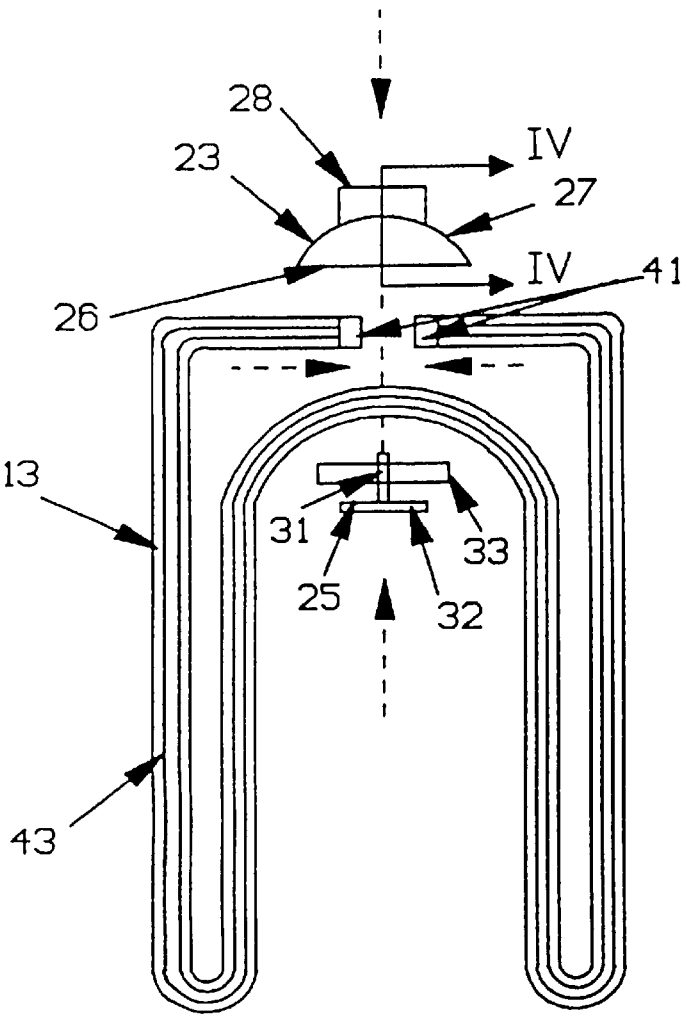

Referring to FIGS. 2–4, the fitting 21 which is conventional and commercially available, has a plunger 23 and a clamp 25. The plunger 23 is bowl shaped (shown in an inverted position in FIGS. 2–4) and rigid. On the inside of the plunger are a plurality of projections (not shown). The projections assist in gripping the string 13, thereby preventing the string from pulling out of the fitting 21. On the outside 27 of the plunger is a coupling portion 28. The coupling portion 28 has a threaded hole 29 therein for receiving the threaded end of the handle 15. Two small bores are received for receiving the clamp 25. The clamp 25 is generally "U" shaped having two projections 31 that are received by the bores 30. A cross-piece 32 extends between the two projections 31. The projections 31 have a barbed structure (not shown), which cooperates with a lip (not shown) inside of the bores 30 so as to provide a one way locking mechanism. The projections 31 can be easily pushed into the bores; removal of the projection from the bores is difficult.

A scrubber or sponge 33 can be coupled to the bottom surface of the fitting. An operator utilizes such a scrubber or sponge to scrub stubborn stains and other things during mopping.

Figure 5:
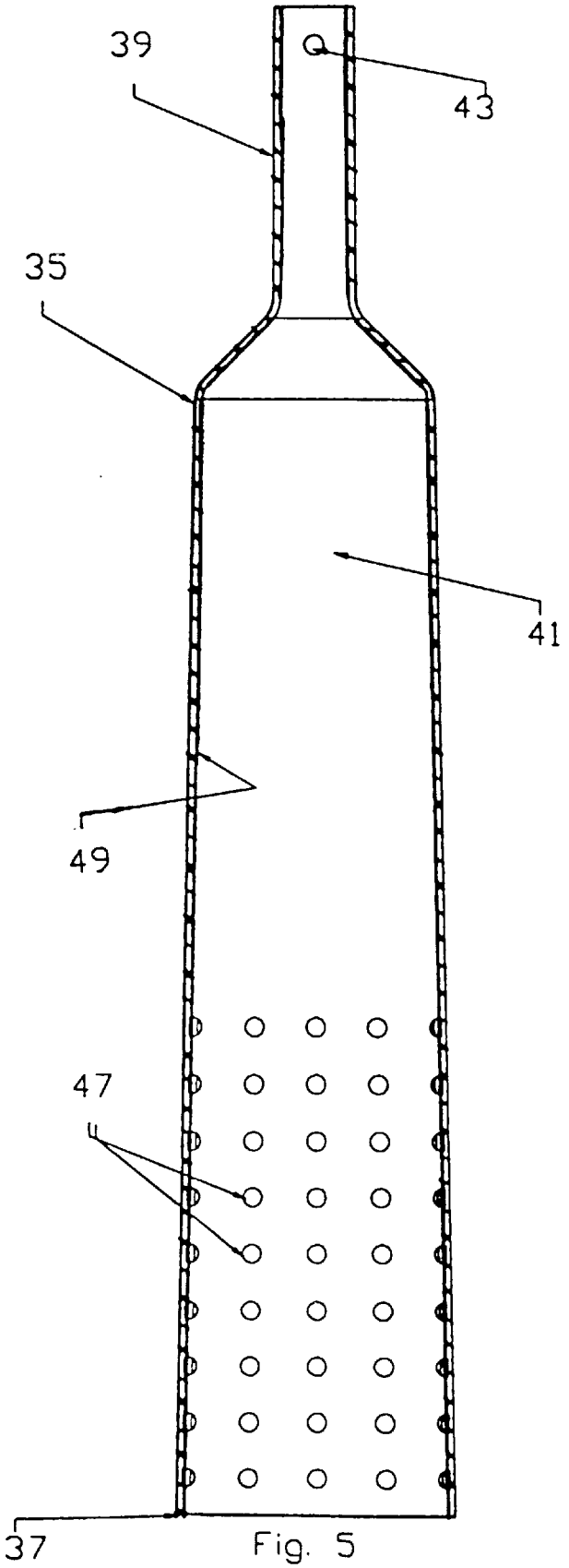
FIG. 5 is a longitudinal cross-sectional view of the sleeve.

The sleeve 19 is shown in FIG. 5. The sleeve 19 has a first end 35 and second end 37. Extending along a longitudinal axis of the sleeve from the first end is a sleeve handle 39. The sleeve handle 39 has an inside diameter that is slightly larger than the outside diameter of the mop handle 15. The sleeve handle 39 is grasped by the operator in order to move the sleeve along the mop handle. The sleeve handle can slide along the mop handle.

Figure 6:
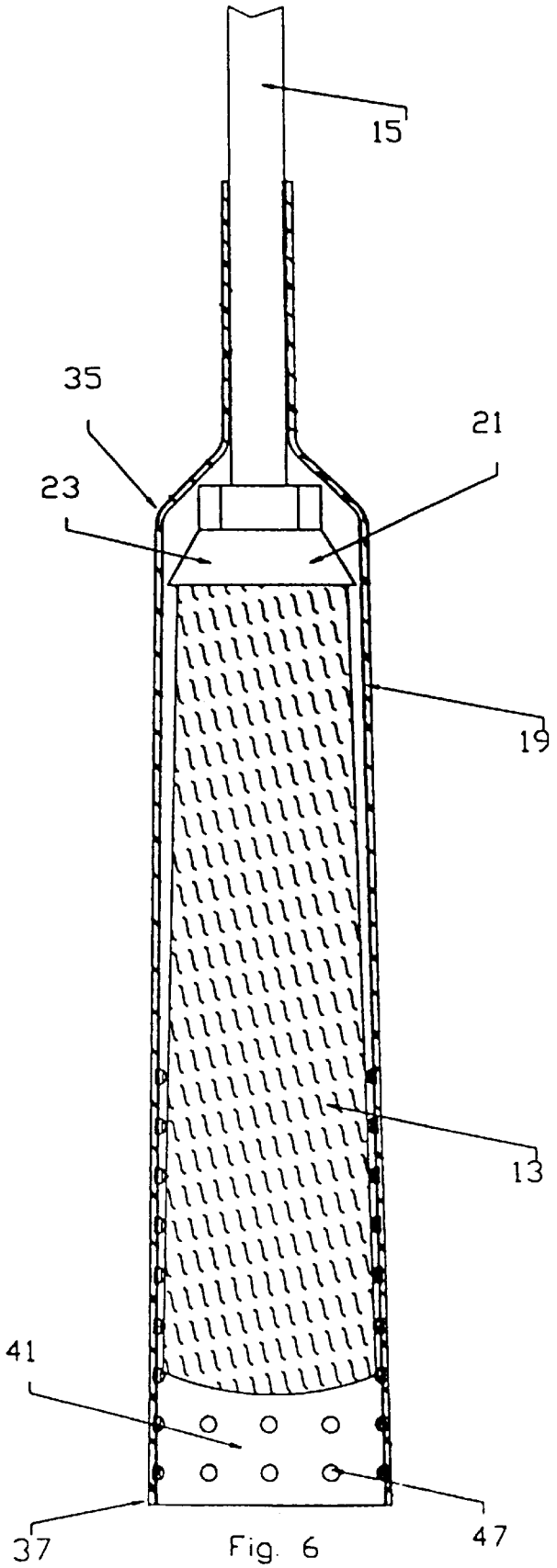
FIG. 6 is a longitudinal cross-sectional view of the sleeve as installed on the mop, showing the mop head in an uncompressed condition.

The inside diameter of the sleeve 19 substantially increases just below the sleeve handle (at the first end) in order to accommodate the mop head 17. Thus, a cavity 41 is formed by the sleeve, which cavity extends from the second end 37 to the first end 35. As shown in FIG. 6, the length of the cavity 41 is sufficient such that the entire mop head 17 can be fully contained inside of the sleeve. The second end 37 of the sleeve is open to allow the mop head to pass therethrough. The first end 35 of the sleeve is effectively closed when the sleeve is mounted onto the mop handle.

Figure 11:
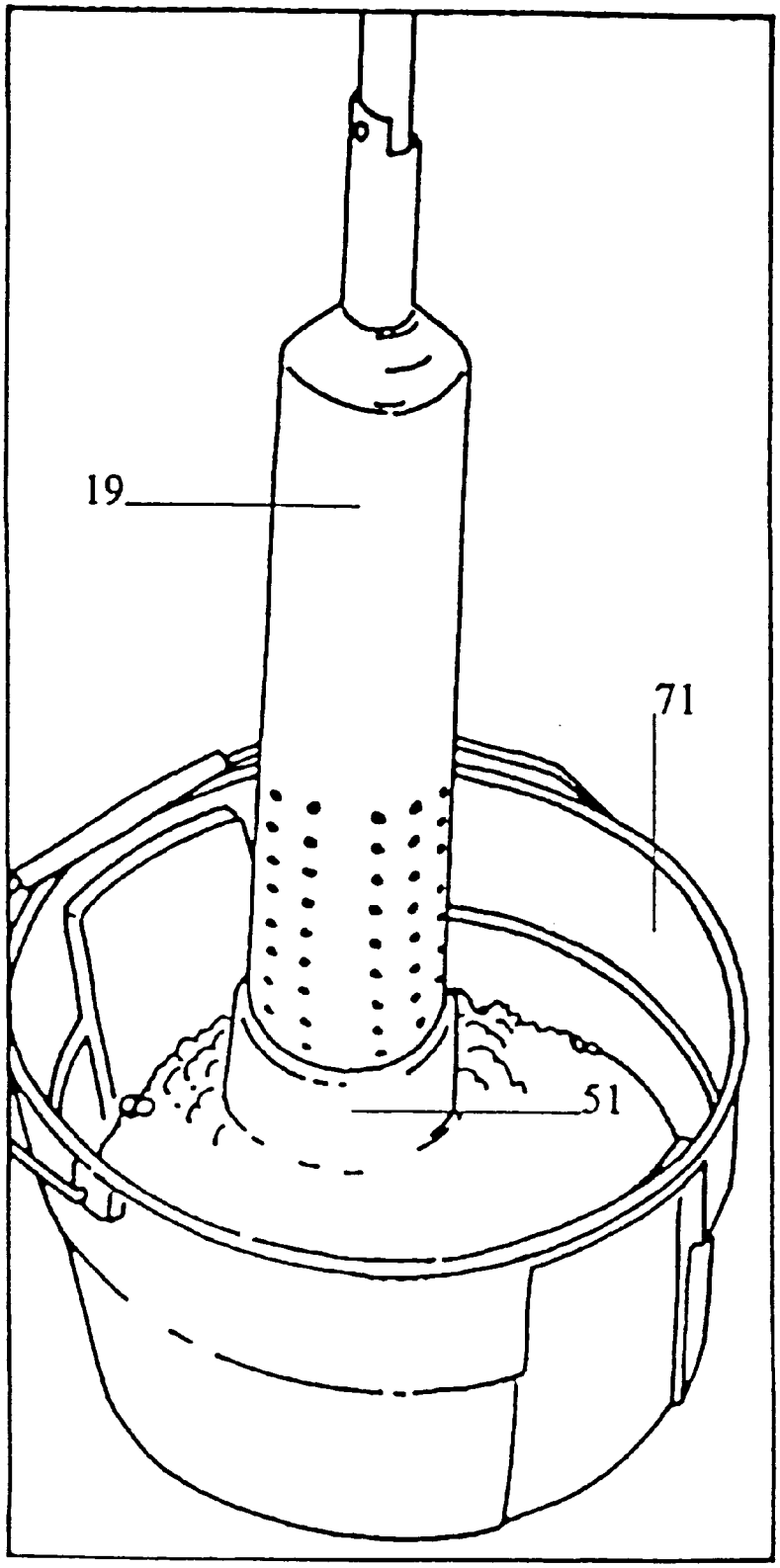
FIG. 11 is a view of the lower end of the mop sleeve, seated on the plunger post of FIGS. 9 and 10 readied for wringing.

The sleeve 19 can be slid between first and second positions along the mop handle. The first position is shown in FIG. 1, wherein the mop head is uncovered by the sleeve and the sleeve is located, or stowed, between the two ends of the mop handle. This first position is used during mopping operations. The second position is shown in FIGS. 6 and 11, wherein the mop head is inside of the sleeve. The second position is used during wringing operations.

A retaining mechanism can be used to maintain the sleeve in the first position. In the preferred embodiment, the retaining mechanism includes an opening 43 (see FIG. 5) in the sleeve handle 39 and a depressible button 45 (see FIG. 1) in the mop handle. The button 45 is spring loaded in a raised position from the mop handle. When the button is received by the sleeve handle opening 43, the sleeve is locked or retained into the first position. To release the sleeve from the first position, the button is depressed into the mop handle.

The sleeve is perforated 47 (see FIG. 5) from the second end 37 toward the central portion of the sleeve. It is preferred that the perforations be confined to the lower or second end portion of the sleeve. (Perforations near the upper or first end portion of the sleeve would be located sufficiently high above the bucket so as to splash or spill wash liquid out of the bucket and onto the floor during wringing operations.) The perforations 47 are sized small enough so that the mop strings will not extrude through the perforations during wringing operations.

The inside cavity 41 of the sleeve 19 is tapered from the first end 35 to the second end 37, as shown in FIG. 5. The inside diameter of the sleeve first end is less than the inside diameter of the sleeve second end. The fitting 21, and especially the plunger 23, can be withdrawn into the sleeve cavity all the way to the first end, as shown in FIG. 6. The inside surface 49 of the sleeve is smooth. The sleeve cavity 41 and mop head 17 are sized relative to each other so as to provide clearance for the mop head when moving the sleeve over the mop head.

The sleeve 19 can be made of plastic.

Figure 7:
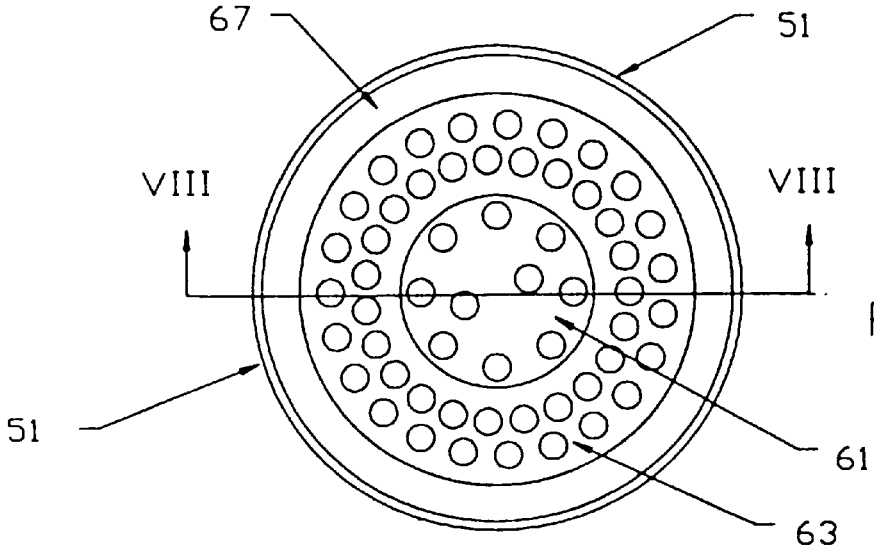
FIG. 7 is a top view of the plunger post of the present invention, in accordance with a preferred embodiment.
Figure 8:
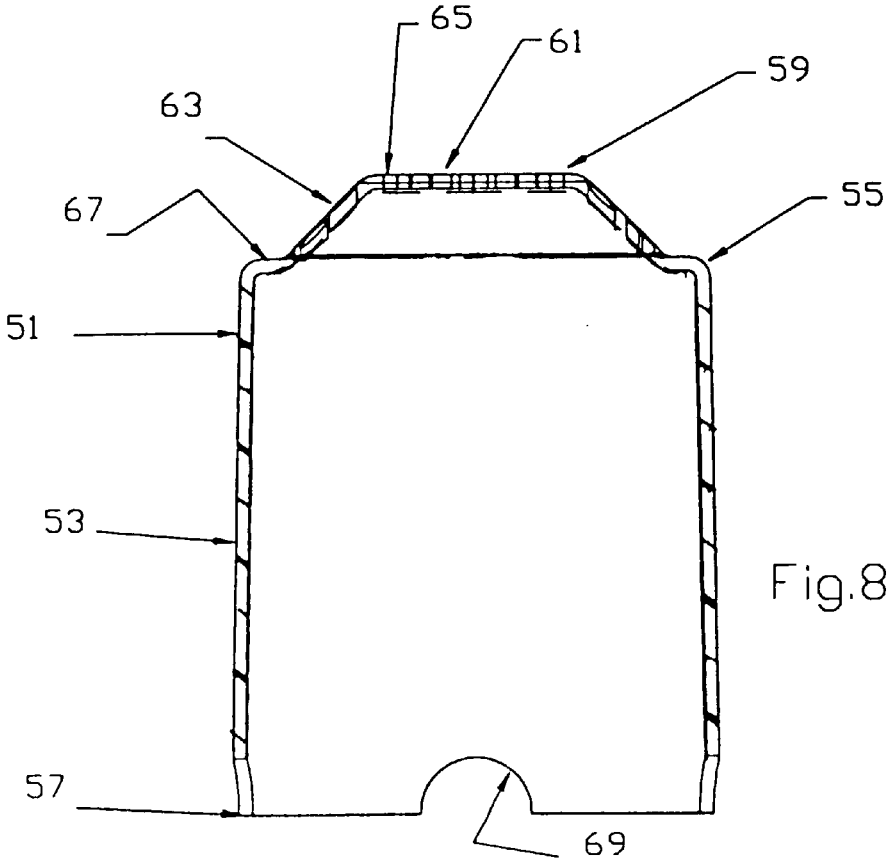
FIG. 8 is an elevational cross-sectional view of the plunger post of FIG. 7, taken through lines VIII—VIII.

The mop 11 can be set against a variety of objects during wringing operations, which operations will be discussed in more detail hereinafter. Once such object is shown in FIGS. 7 and 8 and is referred to as a plunge post 51. The plunge post 51 includes a hollow cylinder 53 having a first end 55 and a second end 57. At the first end 55 of the plunge post is a raised portion 59 having a frusto-conical shape. The raised portion 59 has a center 61 that is horizontal (according to the orientation shown in FIG. 8), and an annular region 63 around the center that is slanted downwardly from the center. The raised portion is perforated 65. The size of the perforations is such that the mop strings will not extrude therethrough during wringing. An annular lip 67 around the raised portion is provided. The lip 67 is horizontal (according to the orientation shown in FIG. 8). The second end 57 of the plunge post 51 is flat. Notches 69 or openings are formed at or near the second end 57 to allow liquid to flow out of the post.

The assembly of the mop 11 will now be described. The sleeve 19 is installed onto the mop handle 15 in the proper orientation. This accomplished by inserting the mop handle 15 through the sleeve handle 39. The mop head 17 is then threaded onto the end of the mop handle to complete the assembly. The mop handle, mop head, and sleeve can be replaced as needed.

Figure 9:
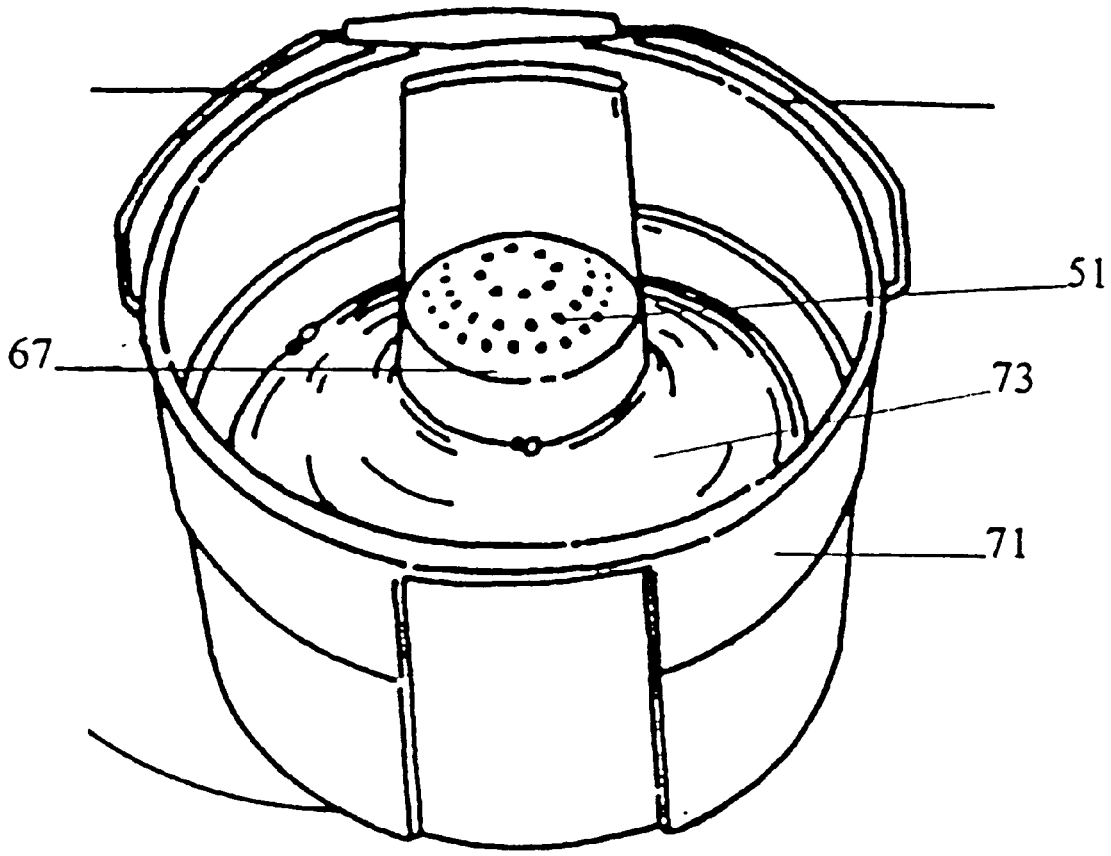
FIG. 9 is a view showing the plunger post in a bucket of wash liquid.

The use of the mop 11 will now be described. A bucket 71 containing suitable wash liquid 73 is provided as shown in FIG. 9. The plunge post 51 is placed in the bucket 71, with the second end of the plunge post contacting the bottom of the bucket. The liquid level is below the lip 67 of the plunge post 51. The plunge post 51 can be located near the side of the bucket to provide more space for the mop head to be immersed in the liquid.

Figure 10:
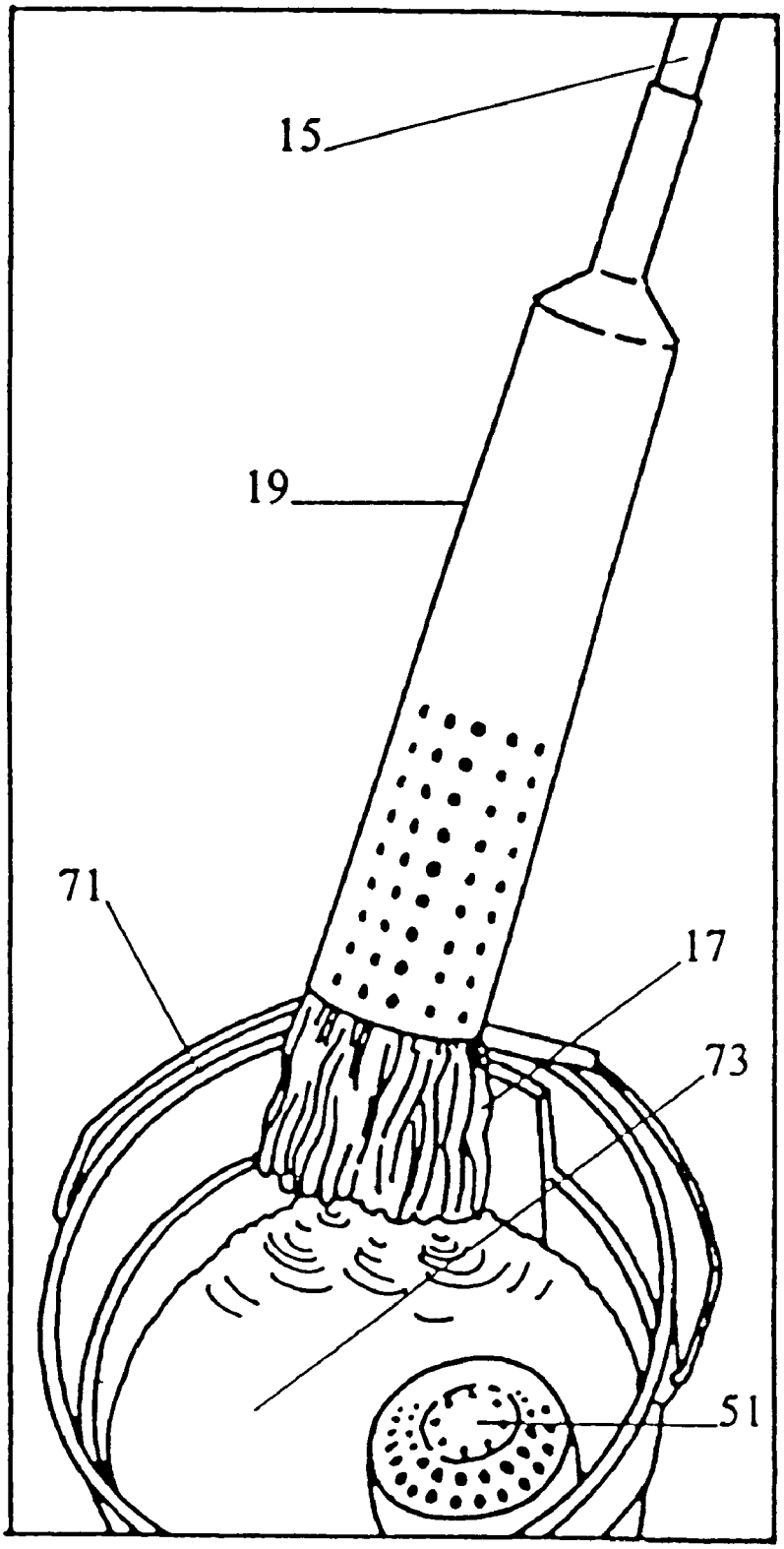
FIG. 10 is a view of the bucket of FIG. 9, with the mop.

Referring to FIG. 10, the mop head 17 is submerged in the wash liquid 73 of the bucket to become wetted. Preferably, the sleeve 19 is in the raised position so as to expose the strings. However, the sleeve could be in the down position.

The excess liquid is wrung out of the strings 13 in the following manner: the mop head 17 is completely withdrawn into the sleeve 19, as shown in FIG. 6. Then, the second end 37 of the sleeve is located on the lip 67 of the plunge post 51 (see FIG. 12). The raised portion 59 of the plunge post serves to align the second end 37 of the sleeve and center the second end of the post.

Figure 12:
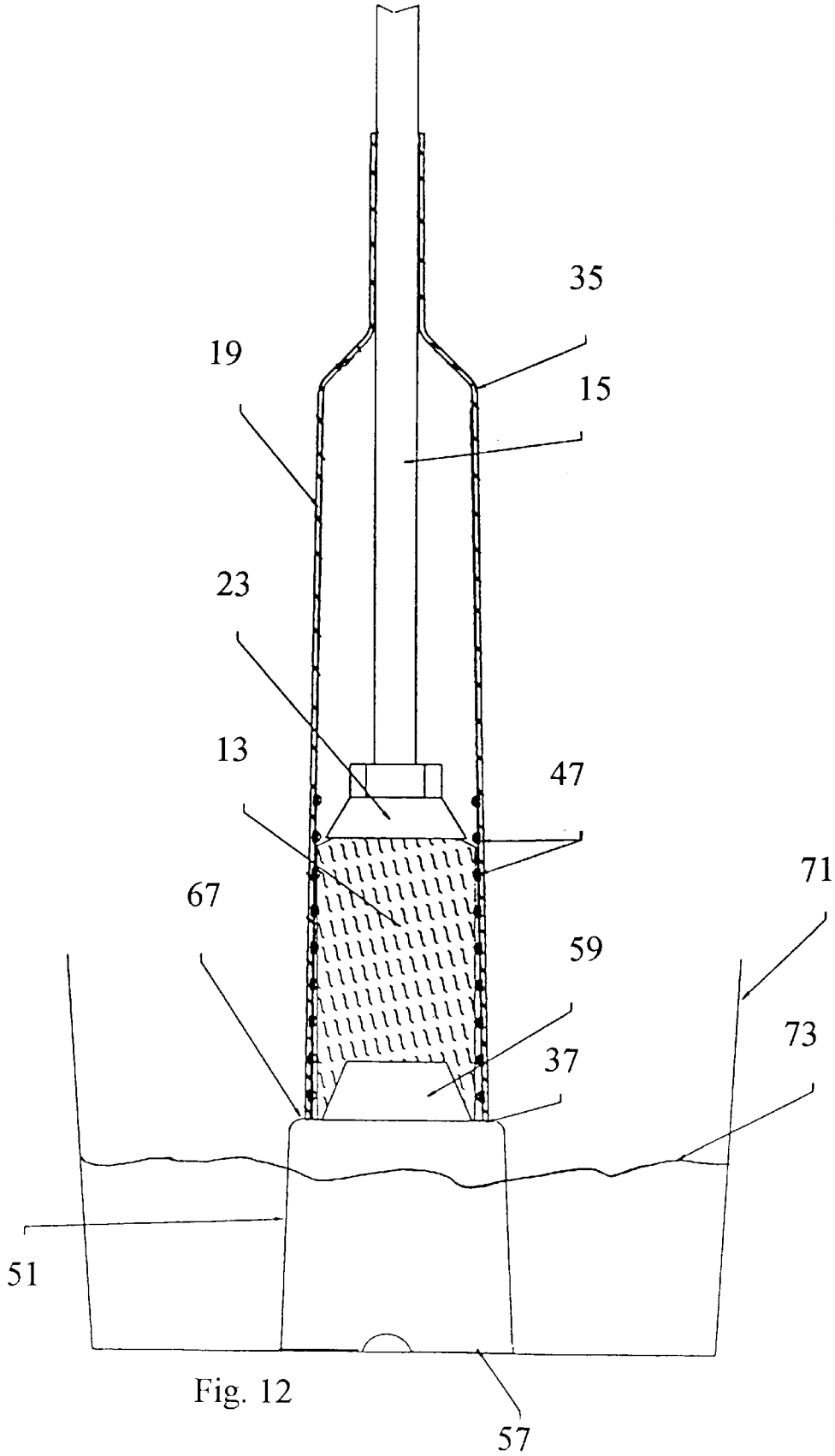
FIG. 12 is a cross-sectional side view of the mop and plunger post of FIG. 11, showing the mop head in a compressed condition.

Once the sleeve 19 is seated onto the plunge post 51, the mop handle 15 is pushed down in a plunging action. The plunger 23 serves as a piston and compresses the mop strings 13 against the raised portion 59, as shown in FIG. 12. This squeezes or wrings the excess liquid out of the mop strings 13, which liquid exits the sleeve through the sleeve perforations 47 and the raised portion 59 perforations.

The operator can perform the wringing or plunging operation while standing. There is no reason to bend down. In addition, one or both hands can be used on the mop handle. Furtherstill, the operator's hands need not get wet during wringing, as they are located above the sleeve. Variable pressure can be applied using the operator's upper body to control the amount of force applied to the mop handle.

The geometry of the plunge post 51 contributes to the wringing of the mop strings. The centered raised portion 59 provides that the mop strings that are located along the longitudinal axis of the sleeve have the highest density (they are compressed the most). In the upper portions of the compressed strings, this squeezes the liquid out of the strings in a radial direction, toward the sleeve perforations. In the lower portions of the compressed strings, more surface area is provided by the raised portion 59 for the liquid to exit the sleeve.

After most of the liquid has been wrung out, the mop handle 15 is raised, the mop is removed from the bucket, and the sleeve is slid up the mop handle to expose the mop head as shown in FIG. 1. The mop can now be used to clean.

The geometry of the sleeve 19 and the plunge post 51 contribute to the ease of returning the mop to use after wringing. During the plunging of the mop handle to wring out liquid, the mop strings 13 become compressed, and consequently form a mass at the second end of the sleeve. This mass could become impacted, wherein the sleeve is prevented from being slid to its up position in an attempt to uncover the mop head. However, the taper of the sleeve 19, widening towards the second end 37, assists in removing the compacted mass of mop string from the sleeve. Also, the raised portion 59 of the plunge post 51 prevents the mop strings from becoming impacted.

Rinsing and rewetting the mop head occurs as described as above. Rinsing the mop head can be enhanced using the plunging action. For example, the sleeve 19 is slid over the mop head and the mop head is immersed in the wash liquid. The mop handle 15 is then plunged up and down several times. This plunging action draws in clean liquid from the bucket on the up stroke of the mop handle and expels dirty liquid from the mop head on the down stroke of the mop handle. The more vigorous the plunging action, the cleaner the mop strings become. The taper of the sleeve (the open bottom end being larger than the top end) assists in plunging the mop head repeatedly for cleaning. Because the sleeve is tapered, the mop head does not become impacted at the bottom end of the sleeve on the handle down stroke. This allows the handle to be picked up for the up stroke. The bottom of the sleeve bears on the bottom of the bucket. After cleaning the mop head, the mop head is wrung by placing the sleeve on the plunge post 51 and following the above described procedures.

Figure 13:
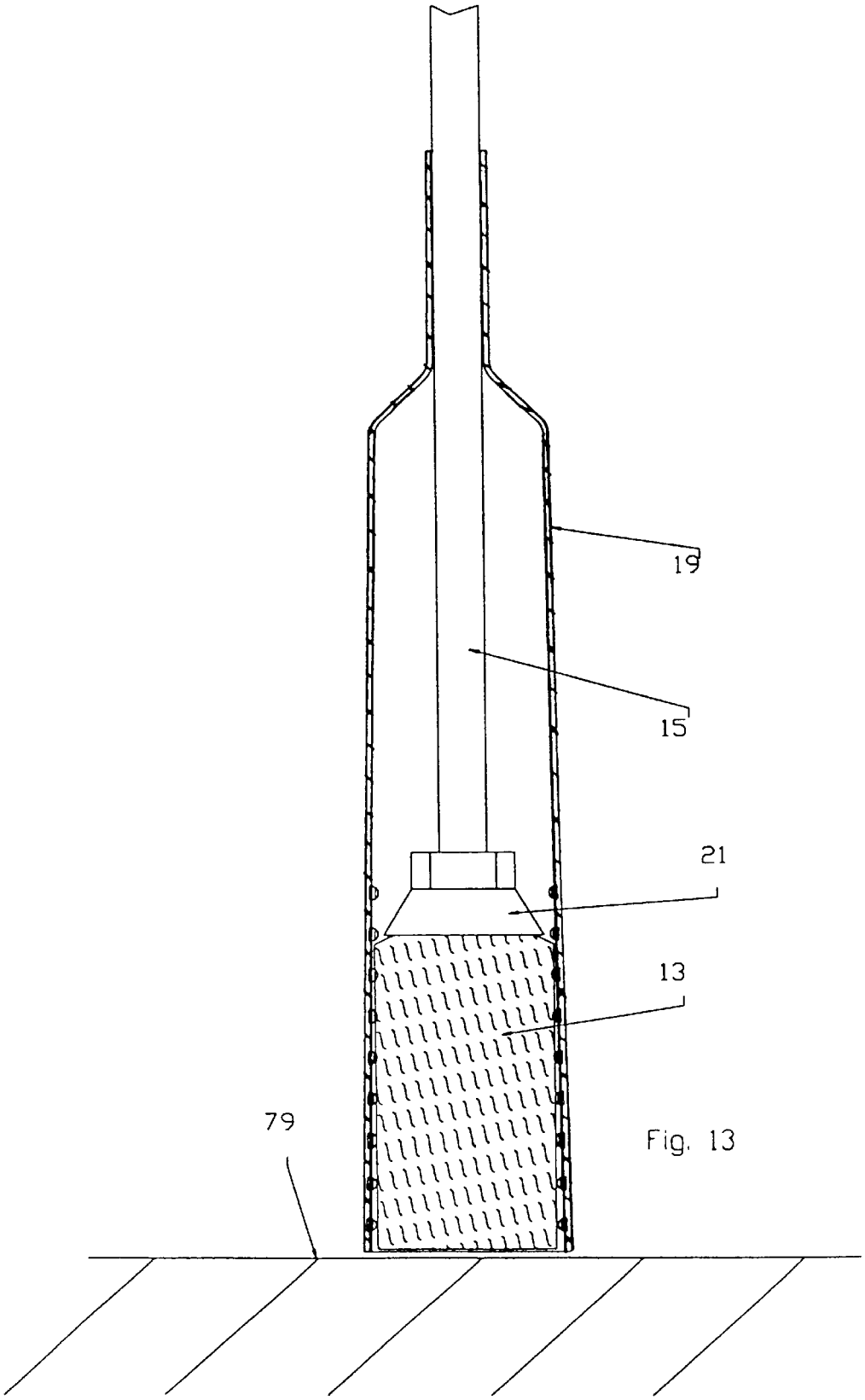
FIG. 13 is a cross-sectional side view of the lower end of the mop, as abutting a surface for wringing.

As discussed above, the mop can be set against a variety of objects during wringing operations. One such object described above is a plunger post 51 shown in FIGS. 7 and 8. The mop can also be set against any surface 79, such as shown in FIG. 13 (for example, a bucket bottom, a bath tub, a shower stall, a kitchen sink, a patio etc.). As the mop handle is plunged toward the surface 79 the liquid is forced from the sleeve through the perforations.

Figure 14:
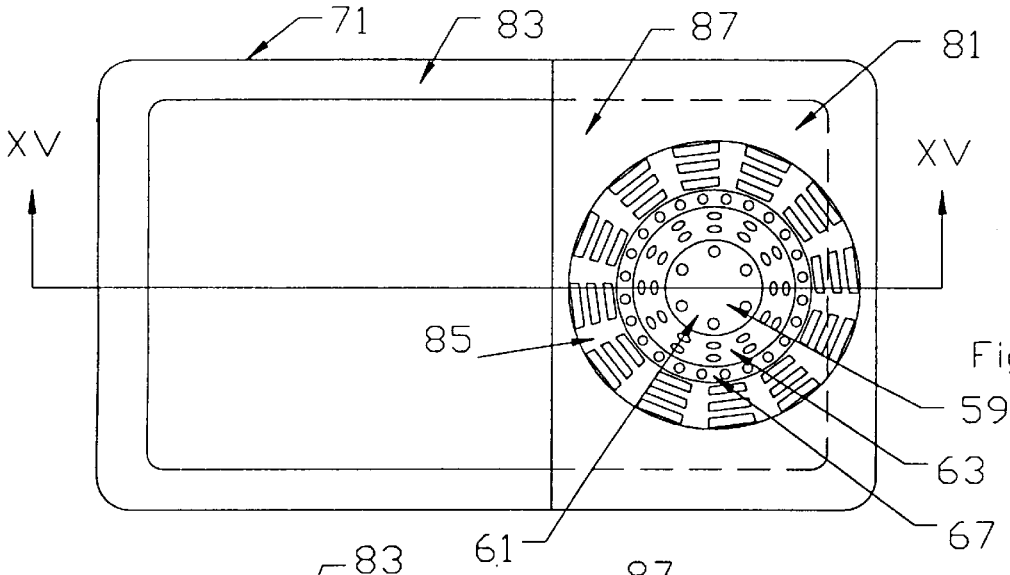
FIG. 14 is a top plan view of a bucket equipped with a plunge basket.
Figure 15:
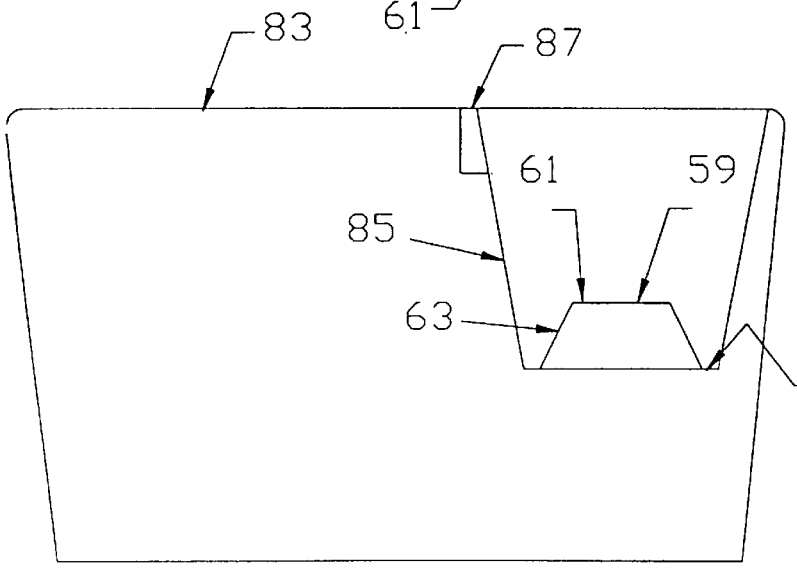
FIG. 15 is an elevational cross-sectional view of the bucket of FIG. 14, taken through lines XV—XV.

Still another object 71 that can be used against the mop during wringing operations is shown in FIGS. 14 and 15. A conventional bucket 71 is equipped with a plunge basket 81. The plunge basket 81 has the perforated raised portion 59 and annular lip 67 of the plunge post 51. However, these elements are supported from the top edge 83 of the bucket instead of from the bottom of the bucket. A frusto-conical, perforated wall 85 extends from the annular lip 67 to the level of the bucket top edge 83. Support walls 87 extend from the top end of the wall 85 to the top edge 83 of the bucket. Thus, the raised portion is located down inside of the bucket, but still above the liquid level.

Figure 16:
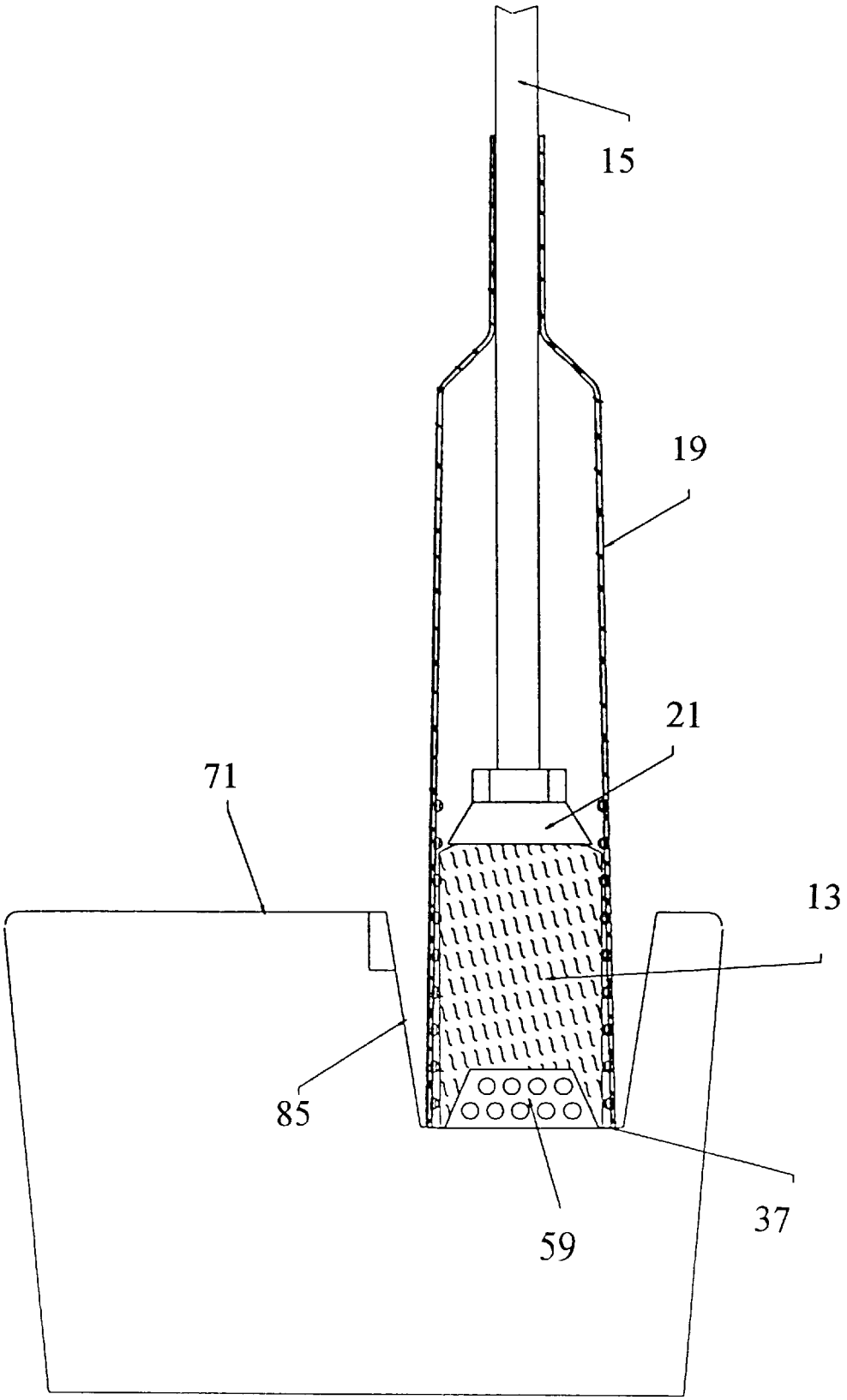
FIG. 16 is a cross-sectional view of the bucket of FIG. 14 and the mop, shown with the mop head in the compressed condition.

FIG. 16 shows the plunge basket 81 in use during a wringing or plunging operation. Excess liquid from the mop head passes through the raised portion 59 and the wall 85, into the basket.

The mop head and sleeve can have a circular cross-section. They can also be provided with other shapes of cross-sections.

The foregoing disclosure and the showings made in the drawings are merely illustrative of the principles of this invention and are not to be interpreted in a limiting sense.

We claim:

1. A method of cleaning a mop, comprising the steps of:

a) providing the mop with a handle, mop strings and a plunger, the plunger being located between the handle and the mop strings;

b) providing a sleeve having a top end and an open bottom end, the sleeve being perforated near the bottom end, the sleeve being tapered so that the bottom end is larger than the top end;

c) locating the plunger and the mop strings inside of the sleeve, with the plunger positioned near the top end of the sleeve and the mop strings depending from the plunger;

d) locating the bottom end of the sleeve in a liquid so that the liquid enters a bottom portion of the sleeve through the perforations;

e) moving the handle down so as to compress the mop strings with the plunger, with the mop strings being immersed in the liquid, thereby forcing dirt from the mop strings out of the sleeve through the perforations;

f) moving the handle up so as to raise the plunger inside of the sleeve and decompress the mop strings, thereby allowing the mop strings to absorb liquid from the outside of the sleeve, through the perforations;

g) repeating steps e) and f) until the mop strings are clean.

2. A method of cleaning a mop having a handle and strings attached to an end of the handle, comprising the steps of;

a) locating the strings inside of a perforated container;

b) locating the perforated container and strings within a liquid;

c) compressing the strings inside of the perforated container while located in the liquid, thereby ejecting liquid from the strings and through the perforations of the container;

d) decompressing the strings inside of the perforated container while located in the liquid, thereby drawing liquid into the decompressed strings through the perforations of the container;

e) repeating steps c) and d) until the strings are clean.

3. The method of claim 2 wherein the step of compressing the strings further comprises the step of moving the handle toward the container and the step of decompressing the strings further comprises the step of moving the handle away from the container.

4. The method of claim 2 wherein the steps of compressing the strings and decompressing the strings further comprises moving a plunger back and forth inside of the container.

5. The method of claim 2 further comprising the steps of:

a) providing the container on the handle in the form of a sleeve;

b) the step of locating the strings inside of a perforated container further comprises moving the sleeve on the handle so as to encompass the strings.

6. The method of claim 2 wherein the container has two ends, with one container end being immersed in the liquid and having a larger inside diameter than the other container end, the step of compressing the strings further comprising the step of moving the strings into the one end of the container and the step of decompressing the strings further comprises the step of moving the strings away from the one end of the container.

7. The method of claim 2 further comprising the steps of:

a) providing the container on the handle in the form of a sleeve, the sleeve having two ends, with one sleeve end being open and having a larger inside diameter than the other sleeve end;

b) the step of locating the strings inside of a perforated container further comprises the step of moving the sleeve on the handle so as to encompass the strings;

c) the steps of compressing the strings and decompressing the strings further comprises the step of moving the handle so as to move a plunger located in the sleeve back and forth inside of the sleeve;

d) the step of compressing the strings further comprises the step of moving the strings into the one sleeve end against a surface.

* * * * *